US006068305A

United States Patent [19]

Myers et al.

[11] Patent Number: 6,068,305

[45] Date of Patent: May 30, 2000

[54] LOCK ASSEMBLY FOR VENDING MACHINES AND METHOD FOR LOCKING AND UNLOCKING SAME

[75] Inventors: Gary L. Myers, Monee; William D. Denison, Palos Hills; Paul D. Caplinger, Tinley Park; Calin V. Roatis, Des Plaines, all of Ill.

[73] Assignee: Fort Lock Corporation, River Grove, Ill.

[21] Appl. No.: 09/112,027

[22] Filed: Jul. 8, 1998

Related U.S. Application Data

[60] Provisional application No. 60/052,064, Jul. 9, 1997.

[51] Int. Cl.[7] ..... E05C 3/06

[52] U.S. Cl. ..... 292/201; 70/78; 292/DIG. 60

[58] Field of Search ..... 292/201, DIG. 60, 292/341.18; 70/279, 278, 78–84

[56] References Cited

U.S. PATENT DOCUMENTS

| | | | |
|---|---|---|---|
| 3,089,330 | 5/1963 | Kerr . | |
| 3,550,412 | 12/1970 | Pitel et al. . | |
| 4,268,076 | 5/1981 | Itoi | 70/279 |
| 4,552,001 | 11/1985 | Roop . | |
| 4,685,316 | 8/1987 | Hicks et al. | 70/270 |
| 4,760,721 | 8/1988 | Steinbach . | |
| 4,802,350 | 2/1989 | Periou | 292/201 |
| 4,899,561 | 2/1990 | Myers . | |
| 4,906,035 | 3/1990 | Nagai et al. | 292/201 |
| 5,351,512 | 10/1994 | Pearlman | 70/279 |
| 5,507,161 | 4/1996 | Broekaert et al. | 292/201 |
| 5,548,982 | 8/1996 | Rawling . | |
| 5,575,515 | 11/1996 | Iwamoto et al. | 70/279 |
| 5,762,384 | 6/1998 | Bartel | 292/201 |
| 5,832,757 | 11/1998 | Chikata et al. | 70/210 |

*Primary Examiner*—B. Dayoan
*Assistant Examiner*—John B. Walsh
*Attorney, Agent, or Firm*—Banner & Witcoff, Ltd.

[57] ABSTRACT

A lock assembly for a vending machine is provided for locking and unlocking a movable door of the vending machine with a remotely controlled electronic latching mechanism. The lock assembly includes at least one keeper assembly disposed on the door of the vending machine and at least one latching mechanism disposed within the interior of the vending machine and positioned for selective interaction and engagement with the keeper assembly when the door is moved between open, intermediate, and closed positions. When the door is moved from the open position toward the intermediate position, the latching mechanism captures the keeper assembly. Once captured, the latching mechanism is then withdrawn within the vending machine to pull the door into the closed position wherein a gasket disposed between the door and the vending machine is substantially uniformly compressed and sealed around its periphery. The lock assembly is also provided with a remote control unit which provides instructions to the electronic circuitry of the locking mechanism. For example, when the door is in the closed position, the door may be opened by transmitting a remote control signal from the remote control unit to the electronic circuitry of the locking mechanism.

19 Claims, 11 Drawing Sheets

FIG. 7
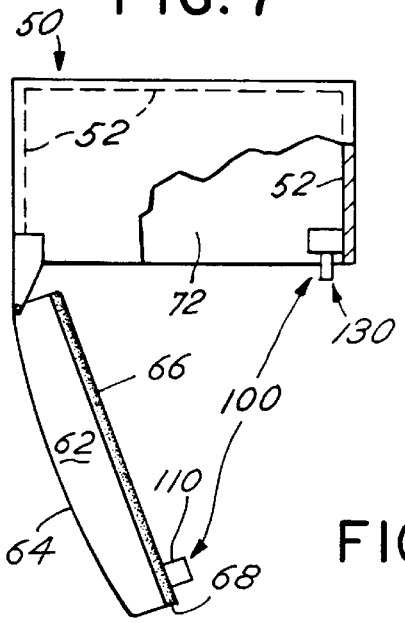
FIG. 8
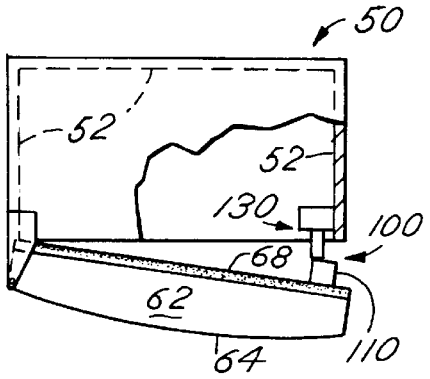
FIG. 9
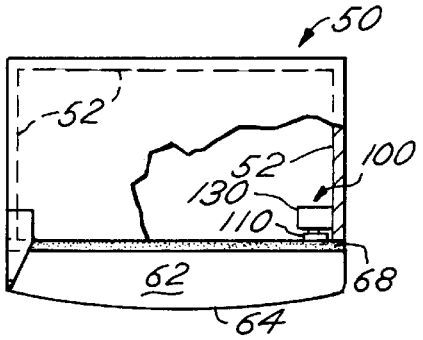
FIG. 10
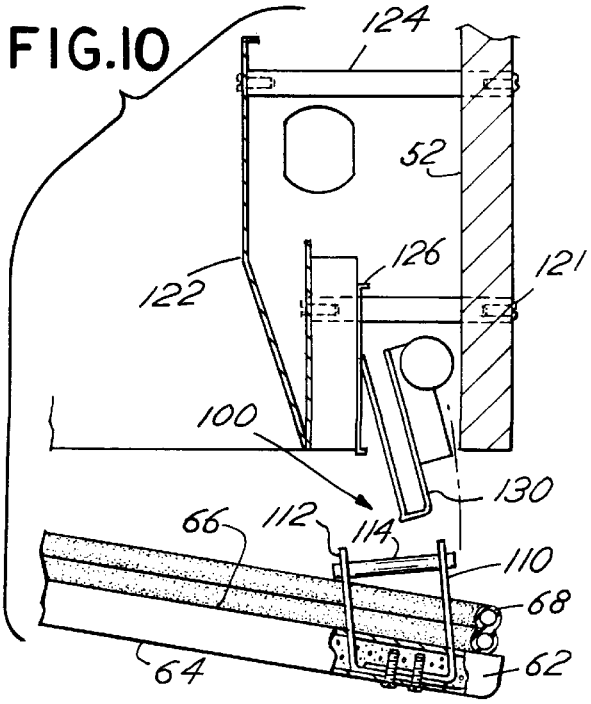
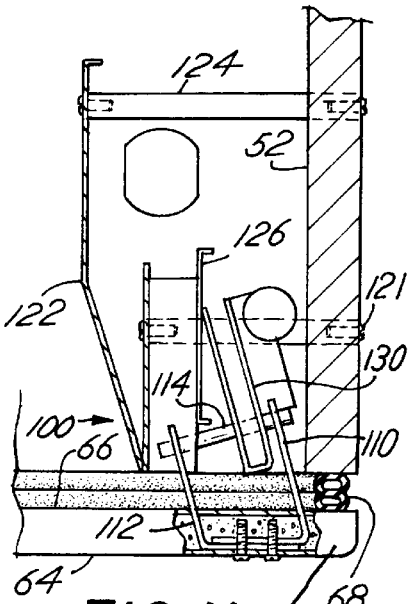
FIG. 11

LOCK ASSEMBLY FOR VENDING MACHINES AND METHOD FOR LOCKING AND UNLOCKING SAME

This application claims the benefit of U.S. Provisional Application Serial No. 60/052,064, filed Jul. 9, 1997.

FIELD OF THE INVENTION

The present invention relates generally to locking devices and, more particularly, to a lock assembly for vending machines and a method for locking and unlocking same with a remotely controlled electronic latching mechanism.

BACKGROUND OF THE INVENTION

Vending machines such as food machines, candy machines, refrigerated drink machines, and the like are ordinarily provided with a lock assembly to prevent unauthorized access to the contents thereof. For example, some vending machines are provided with a key-activated lock assembly such as a pop-out T-handle lock assembly which allows an authorized user to open the door of the vending machine with a properly-encoded key. Such T-handle lock assemblies are well known in the art, as evidenced by numerous patents including U.S. Pat. Nos. 3,089,330 (Kerr), 3,550,412 (Pitel et al.), 4,552,001 (Roop), 4,760,721 (Steinbach), 4,899,561 (Myers), and 5,548,982 (Rawling). With such lock assemblies, the door is initially closed in a loose manner to catch the locking components of the lock assembly. Next, the handle of the locking assembly is rotated to draw the door against the housing of the vending machine and to compress a seal between the door and the housing. Other, more modern, vending machines are provided with a keypad-activated lock assembly which permits the door of the vending machine to be opened when a predetermined access code or combination is entered into the keypad. The prior art, however, has failed to provide a lock assembly which automatically pulls the door of a vending machine into a completely closed position against the housing and/or a lock assembly which utilizes a remotely controlled electronic latching mechanism to lock and unlock the door.

OBJECTS OF THE INVENTION

Accordingly, a general object of the present invention is to provide a key-less electronic lock assembly for vending machines and the like.

A further object of the present invention is to provide a key-less electronic lock assembly for vending machines which does not require a keypad.

Another object of the present invention is to provide a lock assembly for vending machines with a remotely controlled electronic latching mechanism.

A related object of the present invention is to provide a method for locking and unlocking vending machines with a remotely controlled electronic latching mechanism.

An additional object of the present invention is to provide a lock assembly having the foregoing characteristics which is reliable, durable, and convenient to use.

SUMMARY OF THE INVENTION

The above objects are accomplished by providing a lock assembly for a vending machine which selectively locks and unlocks a door of the vending machine with a remotely controlled electronic latching mechanism. The lock assembly includes at least one keeper assembly disposed on the door of the vending machine and at least one latching mechanism disposed within the interior of the vending machine and positioned for selective interaction and engagement with the keeper assembly when the door is moved between open, intermediate, and closed positions. When the door is moved from the open position toward the intermediate position, the latching mechanism captures the keeper assembly. Once captured, the latching mechanism is then withdrawn within the vending machine to pull the door into the closed position wherein a gasket disposed between the door and the vending machine is substantially uniformly compressed and sealed around its periphery. The lock assembly is also provided with a remote control unit which provides instructions to the electronic circuitry of the locking mechanism. For example, when the door is in the closed position, the door may be opened by transmitting a remote control signal from the remote control unit to the electronic circuitry of the locking mechanism.

These and other objects, features, and advantages of the present invention will become more readily apparent upon reading the following detailed description of the preferred exemplified embodiment and upon reference to the accompanying drawings wherein:

BRIEF DESCRIPTION OF THE DRAWINGS

FIG. 7 is a fragmentary top plan view of the vending machine showing the door open and the latching mechanisms extended;

FIG. 8 is a fragmentary top plan view of the vending machine showing the door in the intermediate position and the keeper assemblies engaging the latching mechanisms;

FIG. 9 is a fragmentary top plan view of the vending machine swing the door closed and the latching mechanisms retracted to pull the door adjacent to a front side of the vending machine;

FIG. 10 is an enlarged partial top plan view of the lock assembly showing the keeper assemblies spaced apart from the latching mechanisms;

FIG. 11 is an enlarged partial top plan view of the lock assembly showing the door closed, the keeper assemblies captured by the latching mechanisms, and the latching mechanisms retracted to pull the door adjacent to the front side of the vending machine;

Figure 1:
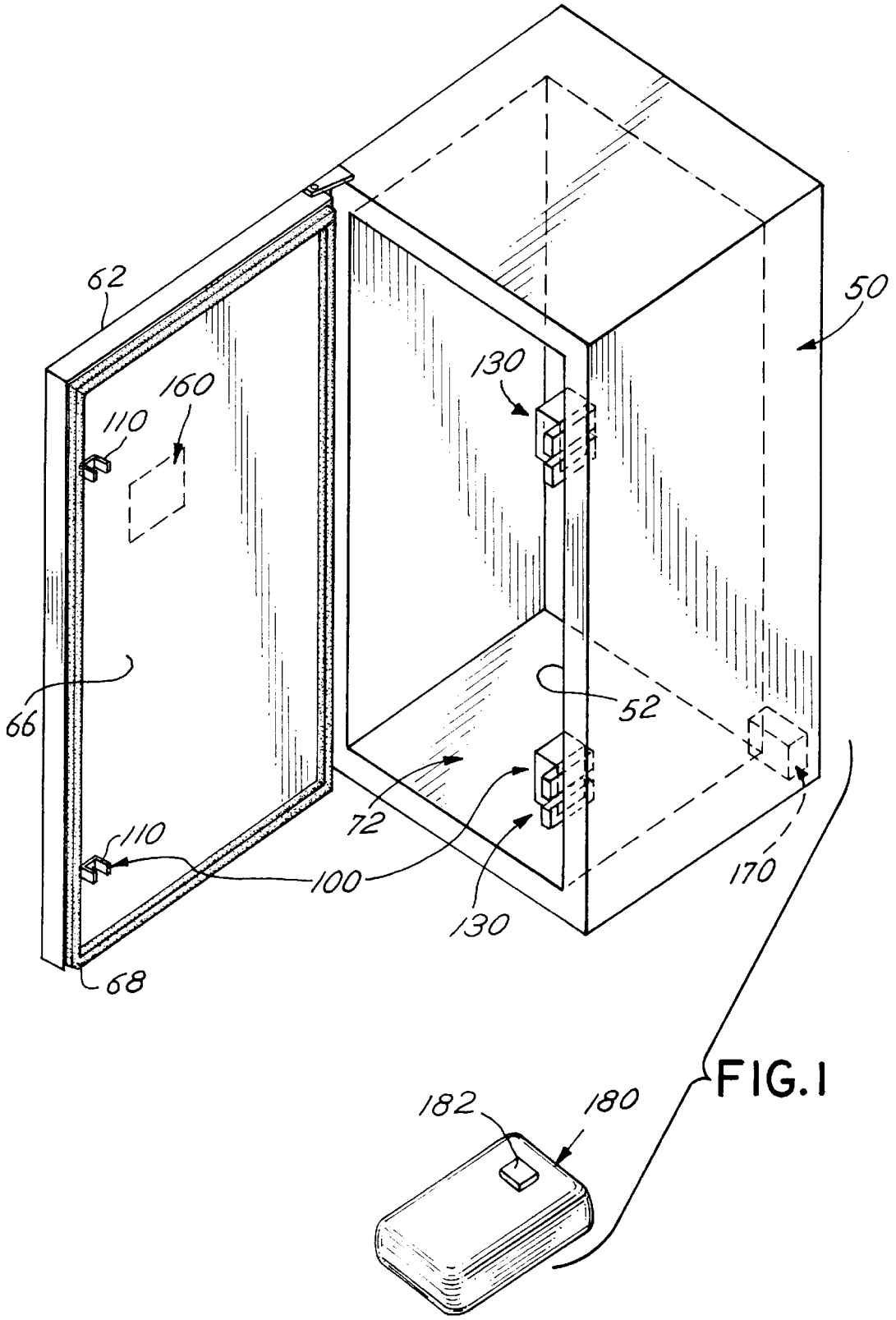
FIG. 1 is a perspective view of a vending machine utilizing a lock assembly constructed in accordance with the present invention and showing the door of the vending machine in an open position.

While the present invention is susceptible to various modifications and alternative constructions, an illustrated embodiment thereof has been shown by way of example in the drawings and will be described in detail below. It should be understood, however, that there is no intention to limit the present invention to the disclosed structural forms. On the contrary, the intention is to cover all modifications, alternative constructions, and equivalents that fall within the scope and spirit of the invention as defined by the appended claims.

DETAILED DESCRIPTION OF THE PREFERRED EMBODIMENT

Turning now to the drawings, an electronic lock assembly constructed in accordance with the present invention is designated generally by reference numeral 100. The inventive lock assembly 100 is intended for use with a vending machine 50 such as a refrigerated drink machine or the like. As is customary in the art, the vending machine 50 includes a plurality of side walls 52 which define a housing and a movable door 62 which is hingedly attached to one of the side walls 52 for movement between an open position, as shown, for example, in FIGS. 1, 5–7, and 10, and a closed position, as shown, for example, in FIGS. 3, 4, 9, and 11. When the door 62 is in the closed position, the side walls 52 and the door 62 define a closed internal compartment 72 of the vending machine 50 where various products (not shown) may be conveniently stored.

As best shown in FIGS. 1, and 6–11, the door 62 of the vending machine 50 includes an outer face side 64 and an inner face side 66 with a gasket 68 disposed around the periphery thereof. In order to substantially prevent the leakage of air from the internal storage compartment 72 of the vending machine 50 when the door 62 is in the closed position, the gasket 68 is substantially uniformly compressed and sealed against the edges of four side walls 52, as shown, for example, in FIG. 11. Although the gasket 68 is specifically shown attached to the inner face side 66 of the door 62, it will be readily appreciated by those skilled in the art that the gasket 68 may alternatively be attached to the edges of the four side walls 52 without departing from the scope or spirit of the present invention.

Figure 2:
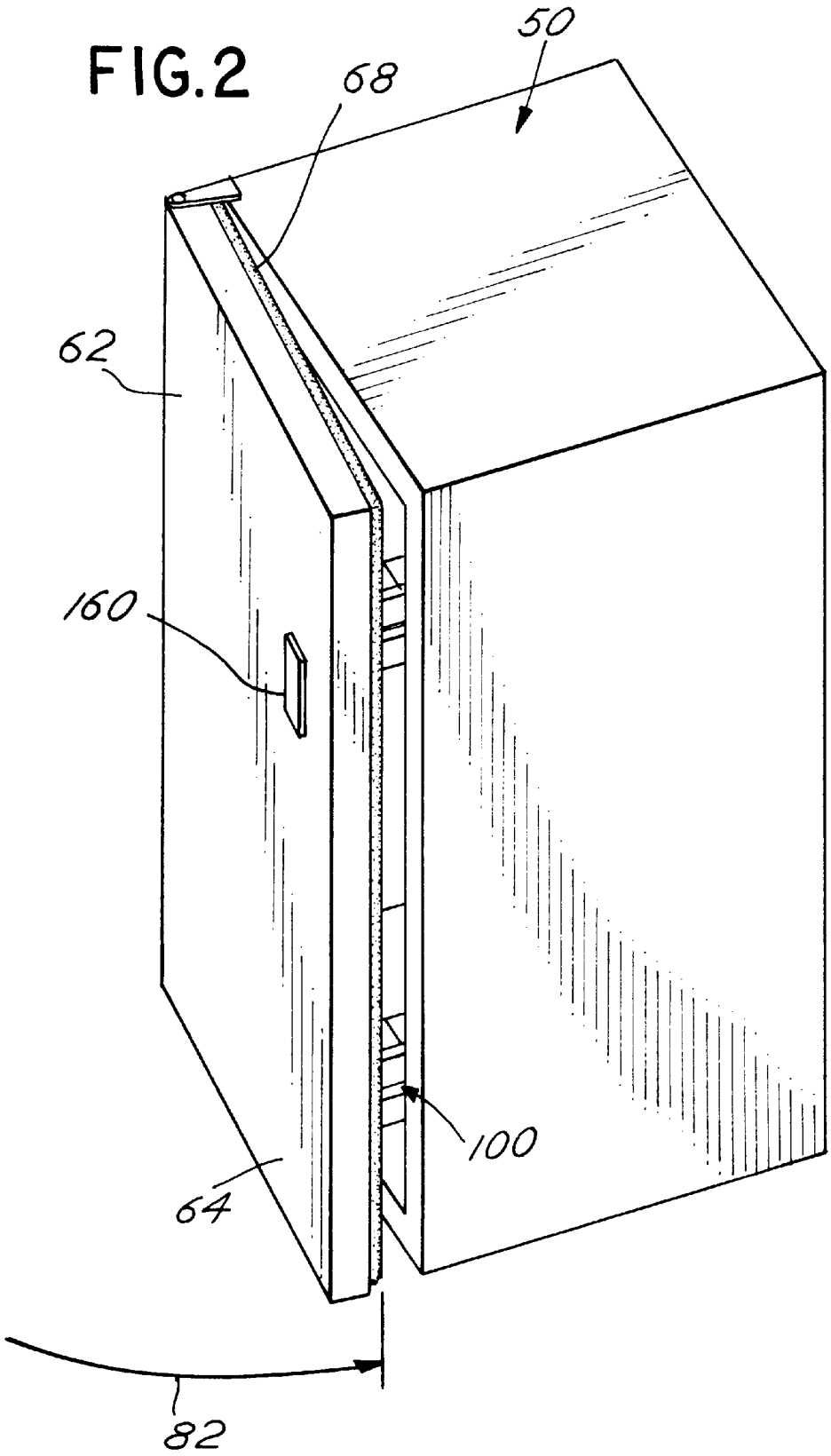
FIG. 2 is a perspective view of the vending machine showing the door in an intermediate position.

In keeping with an important aspect of the present invention, the lock assembly 100 includes a pair of keeper assemblies 110 mounted to the inner face side 66 of the door 60 and a pair of motorized latching mechanisms 130 mounted within the internal compartment 72 of the vending machine 50. As best shown in FIGS. 10 and 11, each keeper assembly 110 includes a support bracket 112 secured to the inner face side 66 of the door 60, and a cross-member 114 carried by the support bracket 112. As will be described in greater detail below, the latching mechanisms 130 are aligned with the keeper assemblies 110 and are adapted to selectively receive and capture the cross-members 114 when the door 62 is moved from the open position towards the closed position, as indicated by reference numeral 82 in FIG. 2, and into an intermediate position. In the intermediate position, the door 62 is not quite fully closed but the keeper assemblies 110 engage the latching mechanisms 130, as shown, for example, in FIGS. 2 and 8.

In the illustrated embodiment, each latching mechanism 130 is slidably carried by a frame or support structure 122. As shown in FIGS. 10 and 11, each support structure 122 is affixed to one of the side walls 52 of the vending machine 50 by a plurality of mounting members 124. In addition, each support structure 122 includes a movable panel 126 which slides relative to that support structure 122 to transport the latching mechanisms 130 between an extended position, as shown in FIG. 10, and a retracted position, as shown in FIG. 11. In the extended position, the latching mechanisms 130 protrude outwardly away from the support structure 122 which allows contact between the cross-members 114 of the keeper assemblies 110 and the latching mechanisms 130 when the door 62 is in the intermediate position.

As shown in FIGS. 12–15, each latching mechanism 130 comprises a rotor latch which includes a base portion 132 affixed to one of the slidable panels 126 of the support structure 122, an opposed cover portion 134, and locking and release levers 142 and 148 pivotably sandwiched between the base and cover portions 132 and 134 by pins 136. In operation, the locking and release levers 142 and 148 of the rotor latches 130 are selectively movable between an unlocked position, as indicated by reference numerals 142*a* and 148*a* in FIG. 15, and an locked position, as indicated by reference numerals 142*b* and 148*b* in FIG. 15. In order to urge or bias the locking and release levers 142 and 148 toward the unlocked position, a biasing element 138 such as a helical coil spring or the like is coupled between the locking lever 142 and the release lever 148, as shown, for example, in FIG. 12.

In the illustrated embodiment, the base and cover portions 132 and 134 of each rotor latch 130 includes a slot 139 which is sized and configured to receive one of the cross-members 114 of the keeper assemblies 110. In addition, the locking lever 142 of each rotor latch 130 includes a cam engagement surface 143, upper and lower engagement surfaces 144 and 145 in the form of ratchet teeth, and a hook portion 146. The release lever 148, in turn, includes a single ratchet tooth 149 which is adapted to selectively engage either the upper engagement surface 144 or the lower engagement surface 145 of the locking lever 142 to locate the locking and release levers 142 and 148 in the unlocked and locked positions.

Figure 15:
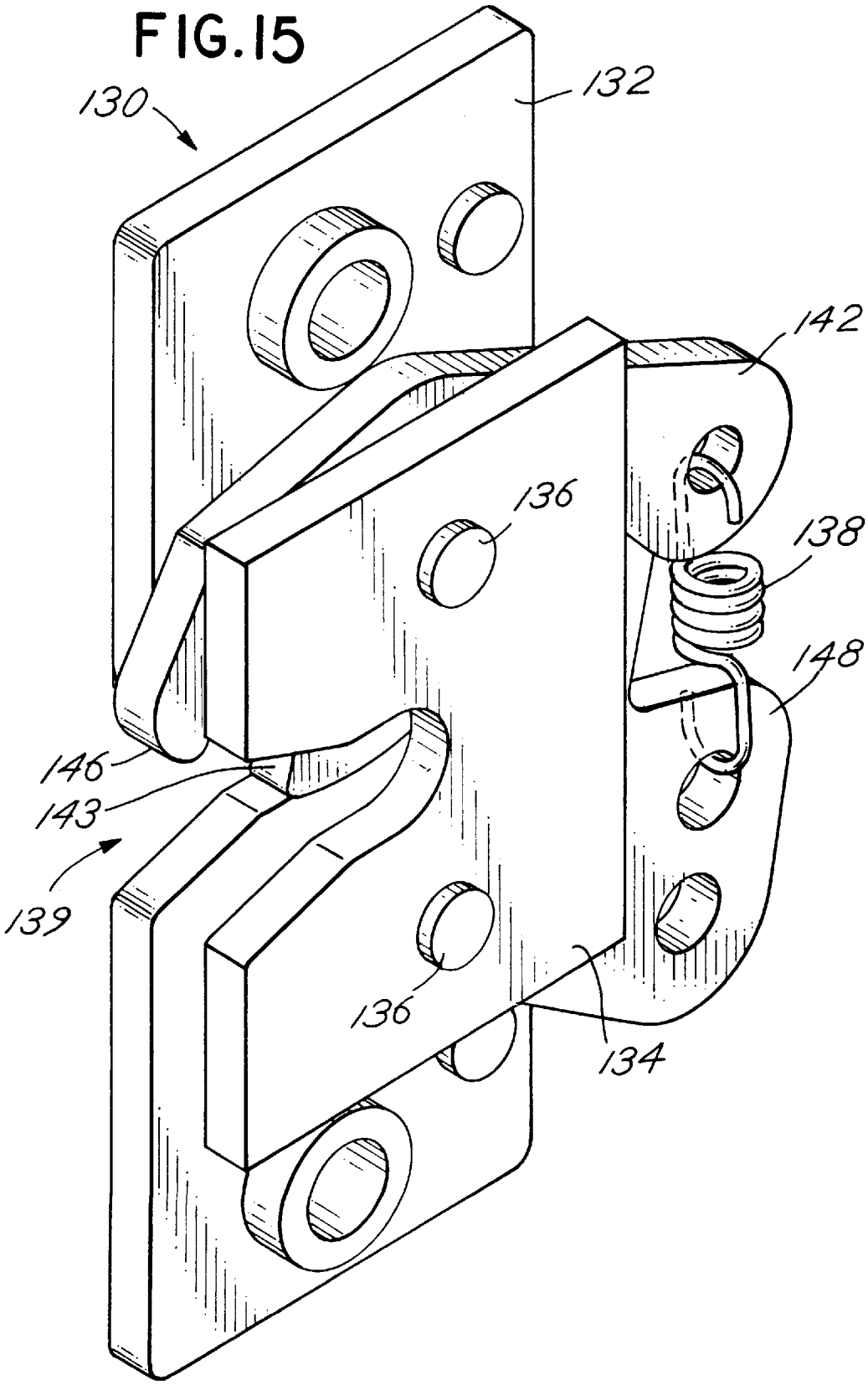
FIG. 15 is a perspective view showing locking and release levers of the latching mechanism moving between locked and unlocked positions.

In the unlocked position, the ratchet tooth 149 of the release lever 148 engages the upper engagement surface 144 of the locking lever 142 which causes the locking and release levers 142 and 148 to assume the unlocked position indicated by reference numerals 142*a* and 148*a*, respectively, in FIG. 15. When the locking and release levers 142 and 148 are in the unlocked position, the hook portion 146 of the locking lever 142 is substantially free of the slot 139, as shown, for example, in FIGS. 12 and 14, which allows the cross-member 114 of one of the keeper assemblies 110 to move inwardly into the slot 139 until the cross-member 114 engages the cam engagement surface 143 of the locking lever 142. Once the cross-member 114 has engaged the cam engagement surface 143, continued inward movement of the cross-member 114 counteracts the biasing provided by spring 138 which causes cooperative rotation of the locking and release levers 142 and 148 toward the locked position, as indicated by reference numerals 142*b* and 148*b* in FIG. 15, while the ratchet tooth 149 of the release lever 148 moves from the upper engagement surface 144 of the locking lever 142 toward the lower engagement surface 145 of the locking lever 142. In the locked position, the hook portion 146 of the locking lever 142 protrudes downwardly to trap or capture the cross-member 114 of the keeper assembly 110 within the slot 139 of the rotor latch 130, as shown, for example, in FIG. 15, and the ratchet tooth 149 of the release lever 148 engages the lower engagement surface 145 of locking lever 142, as shown, for example, in FIG. 13.

In accordance with an important aspect of the present invention, the lock assembly 100 is also provided with electronic circuitry, as indicated diagrammatically by reference numeral 160 in FIGS. 1–5, which, among other things, controls the location of the latching mechanisms 130 with respect to the support structures 122. More specifically, the electronic circuitry 160 selectively activates a motor (not shown) for the latching mechanisms 130 which causes the panels 126 to move inwardly or outwardly with respect to the support structures 122 between the extended and retracted positions. The electronic circuitry 160 of the lock assembly 100 may be provided by a single microcomputer integrated circuit, as disclosed, for example, in U.S. Pat. No. 5,617,082 which is hereby incorporated by reference in its entirety.

In most instances, the electronic circuitry 160 and the motor for latching mechanisms 130 are powered by the same external electrical supply which provides electrical current to the vending machine 50. A conventional wall outlet (not shown) is suitable for this purpose. In order to ensure that the inventive lock assembly 100 will continue to function even after the current from the wall outlet has been cut-off or deactivated during a power failure or the like, a battery backup unit, designated generally by reference numeral 170 in FIG. 1, is mounted to the vending machine 50.

In keeping with an important aspect of the present invention, the lock assembly 100 is also provided with a remote control unit 180 with a button or activation switch 182 which causes the keeper assemblies 110 to disengage the latching mechanisms 130. When this button 182 is depressed, a predetermined remote control signal 184 is provided to the electronic circuitry 160, as indicated, for example, in FIG. 4. Upon receiving this signal 184, the electronic circuitry 160 of the locking mechanism 100 delivers an input command or signal to the motor of latching mechanisms 130 instructing it to exert a force on the latching mechanisms 130, as indicated, for example, by reference numeral 92 in FIG. 13. This force 92 moves the locking and release levers 142 and 148 from the locked position toward the unlocked position and also causes the cross-members 114 of the keeper assemblies 110 to be expelled from the slots 139 of the latching mechanisms 130 as the door 62 of the vending machine 50 pivots toward the open position, as shown in FIG. 5. After the cross-members 114 have been expelled from the slots 139 of the latching mechanisms 130, the electronic circuitry 160 delivers another input signal to the motor of the latching mechanisms 130 instructing it to move the latching mechanisms 130 from the retracted position toward the extended position, as indicated, for example, by reference numeral 94 in FIG. 6.

Figure 3:
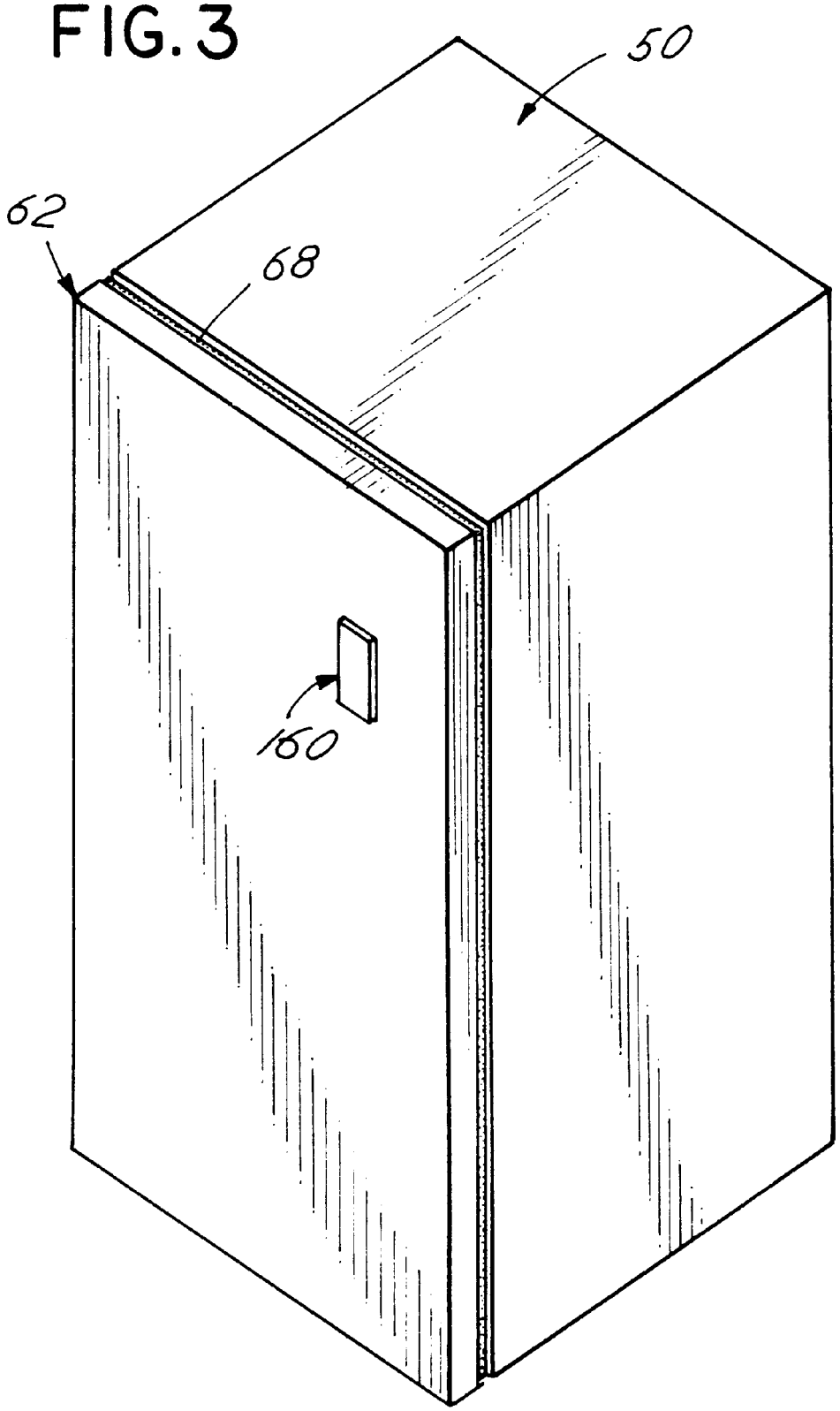
FIG. 3 is a perspective view of the vending machine showing the door in a closed position.

In use, the inventive lock assembly 100 operates in the following manner. When the door 62 is manually moved inwardly from the open position shown in FIGS. 1 and 7 toward the intermediate position shown in FIGS. 2 and 8, the cam engagement surfaces 143 of the two locking levers 142 are struck by the cross-members 114 of the two keeper assemblies 110. This engagement between the cross-members 114 of the keeper assemblies 110 and the cam engagement surfaces 143 of the locking levers 142 causes the locking and release levers 142 and 148 to move from the unlocked position toward the locked position so as to capture the cross-members 114 within the slots 139 of the latching mechanisms 130 and against the hook portions 146 of the locking levers 142, as shown in FIG. 15. Once the cross-members 114 of the two keeper assemblies 110 are captured in this manner, the electronic circuitry 160 delivers a signal to the motor of the latching mechanisms 130 instructing it to transport the latching mechanisms 130 from the extended position toward the retracted position so as to draw the door 62 into the closed position, as shown in FIGS. 3 and 9, until the gasket 68 is substantially uniformly compressed and sealed against the edges of the side walls 52 of the vending machine 50.

Figure 4:
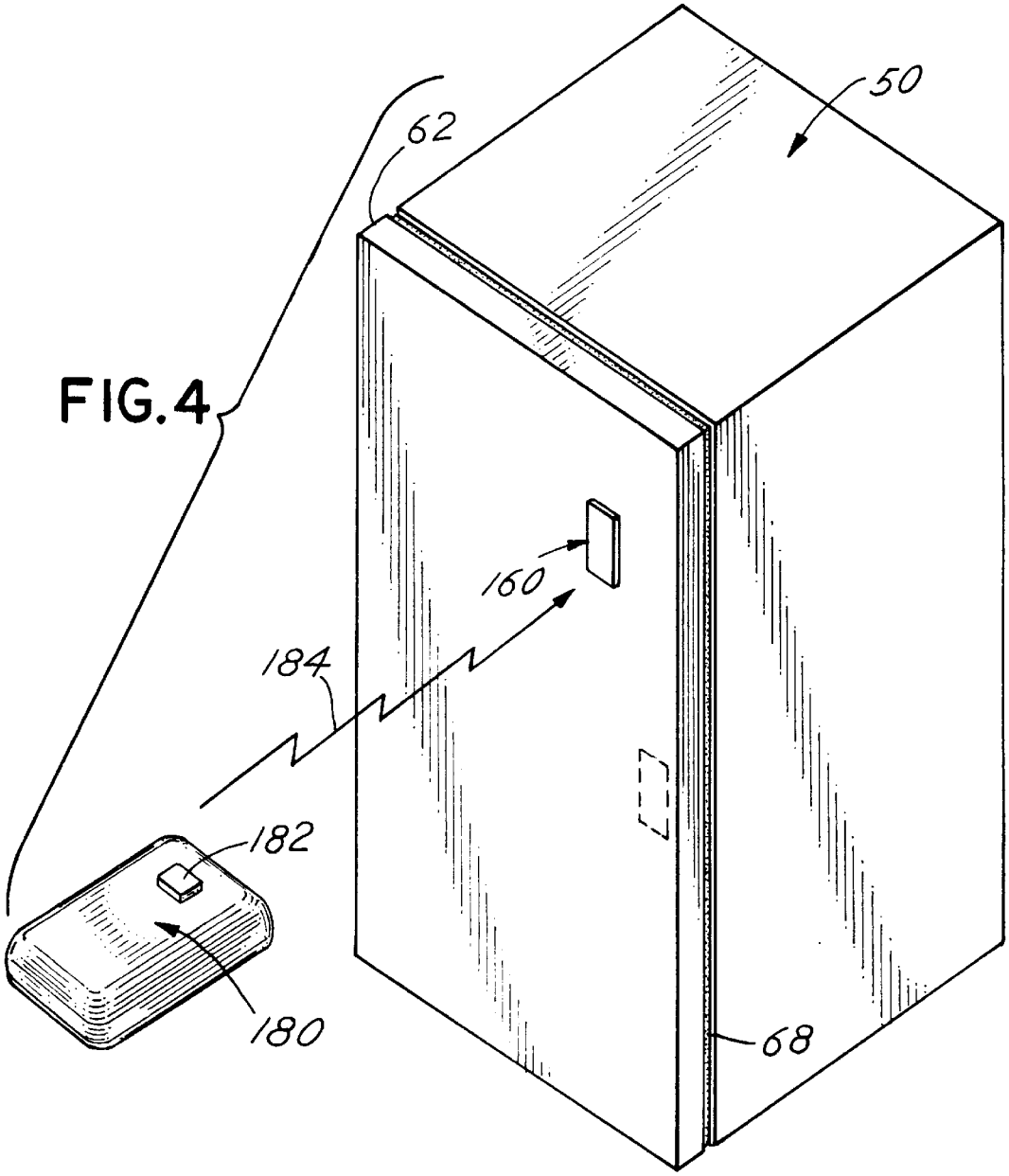
FIG. 4 is a perspective view of the vending machine showing the door in the closed position and showing a remote control unit of the lock assembly transmitting a signal to the electronic circuitry of the lock assembly to effectuate release of keeper assemblies disposed on the door from latching mechanisms disposed within the vending machine.
Figure 5:
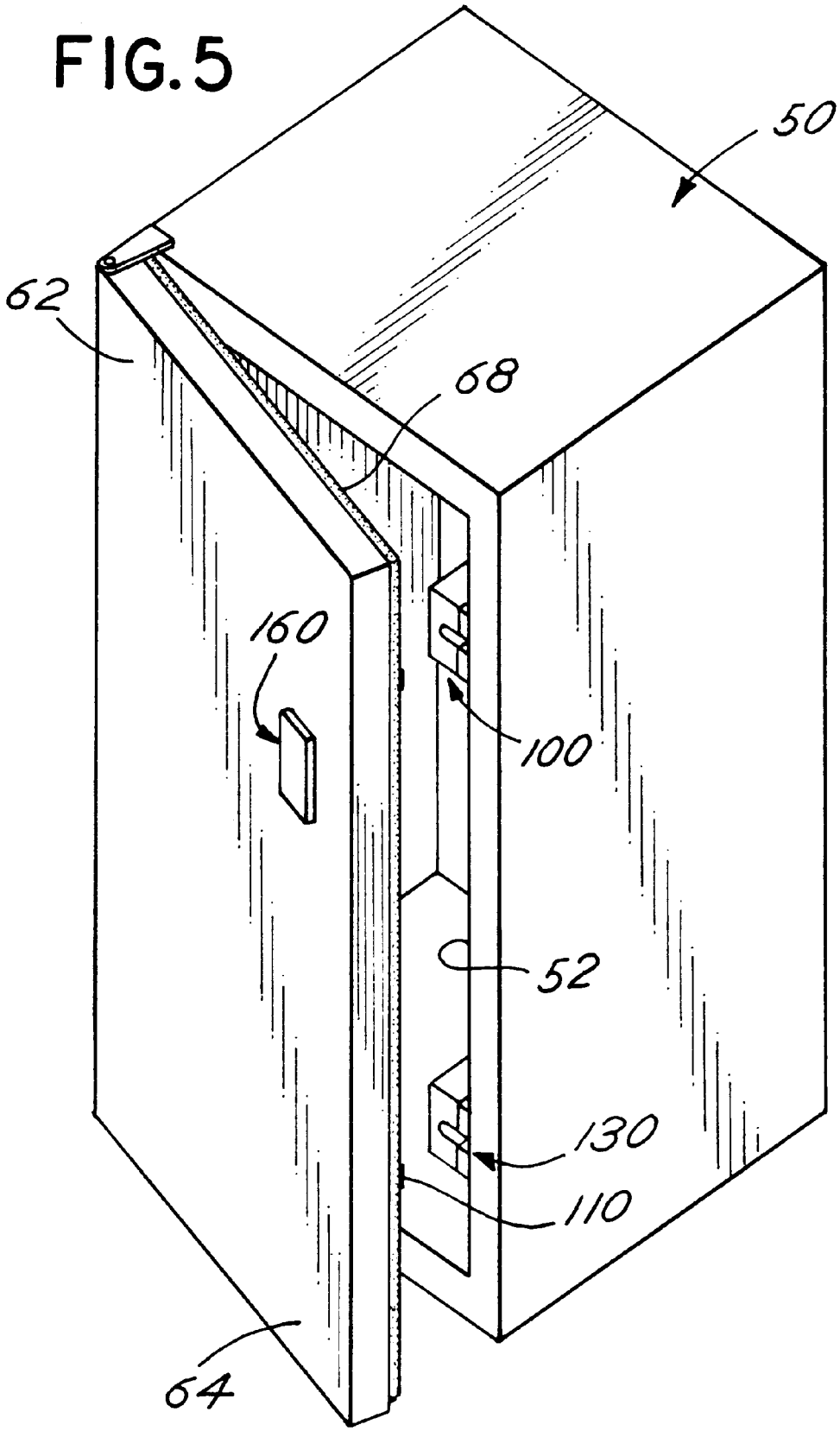
FIG. 5 is a perspective view of the vending machine after the keeper assemblies have been released by the latching mechanisms and the door has swung open.
Figure 6:
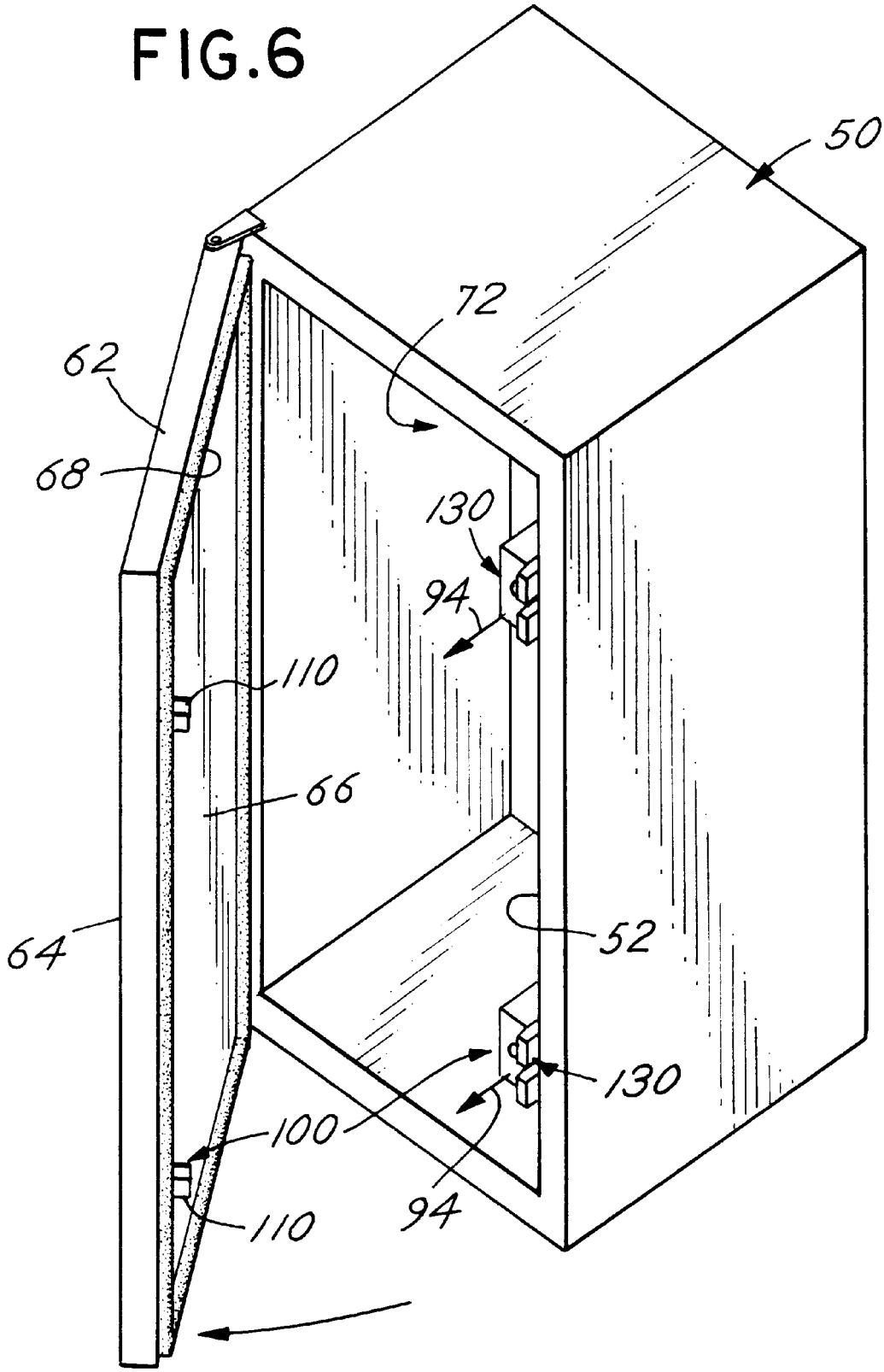
FIG. 6 is a perspective view of the vending machine showing the door open and the latching mechanisms extended.
Figure 12:
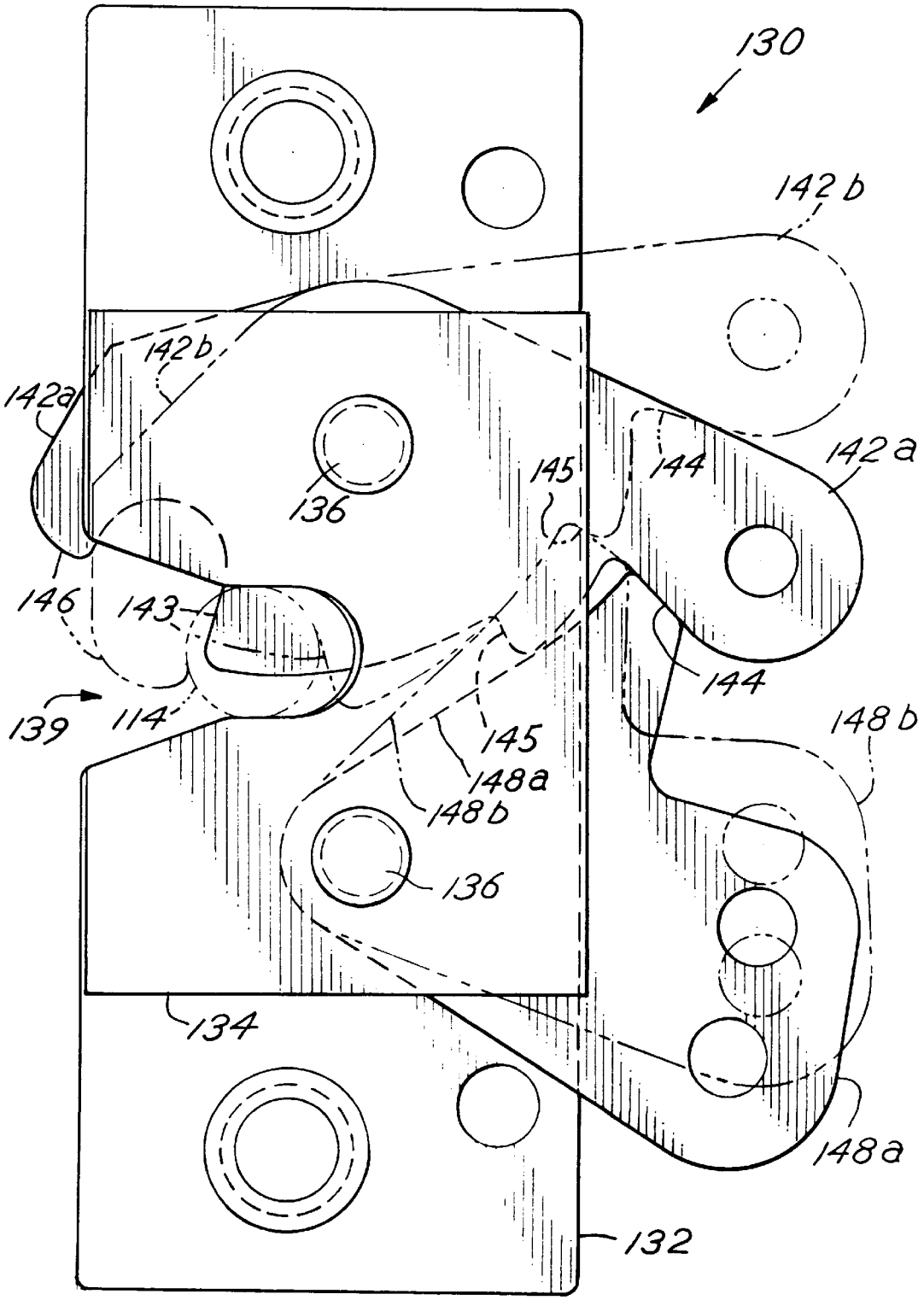
FIG. 12 is an enlarged perspective view of one of the latching mechanisms.
Figure 13:
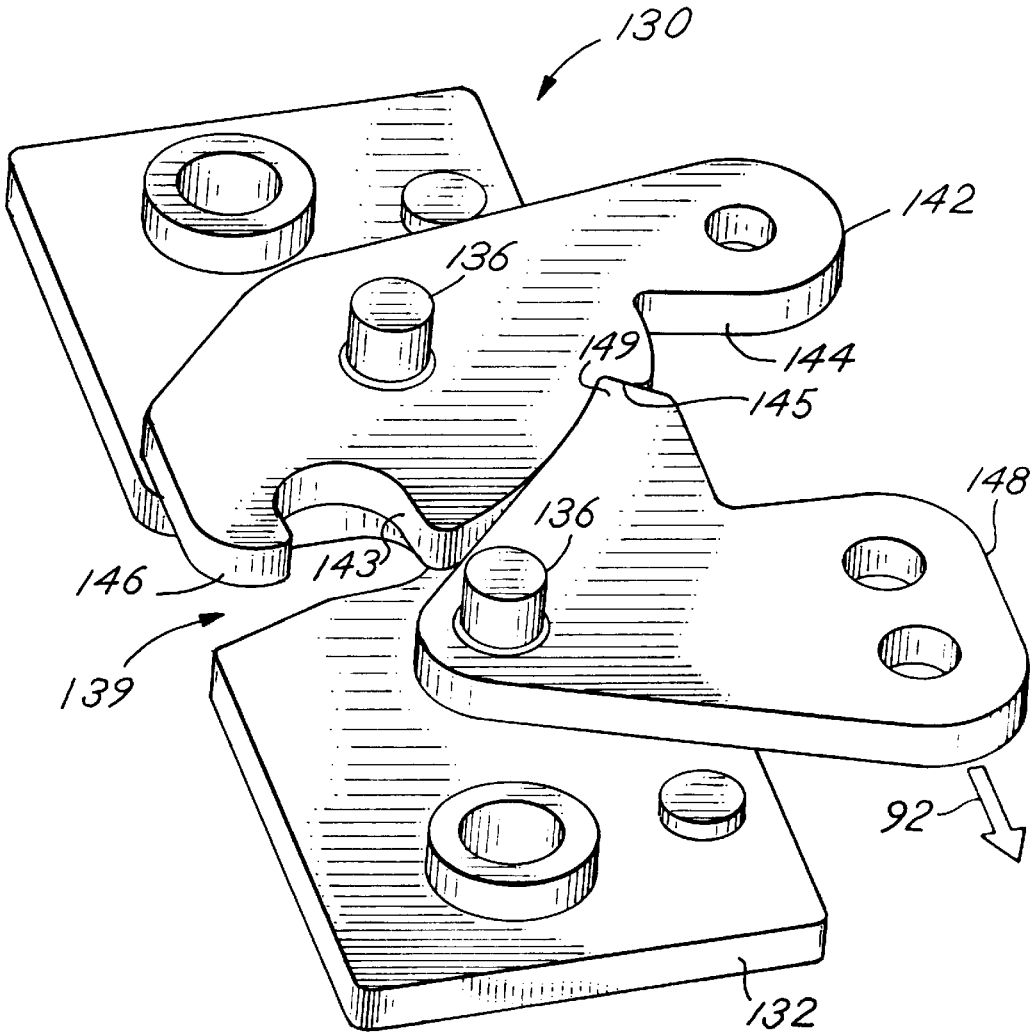
FIG. 13 is a perspective view of the latching mechanism depicted in FIG. 12 with some of the components removed for clarity.
Figure 14:
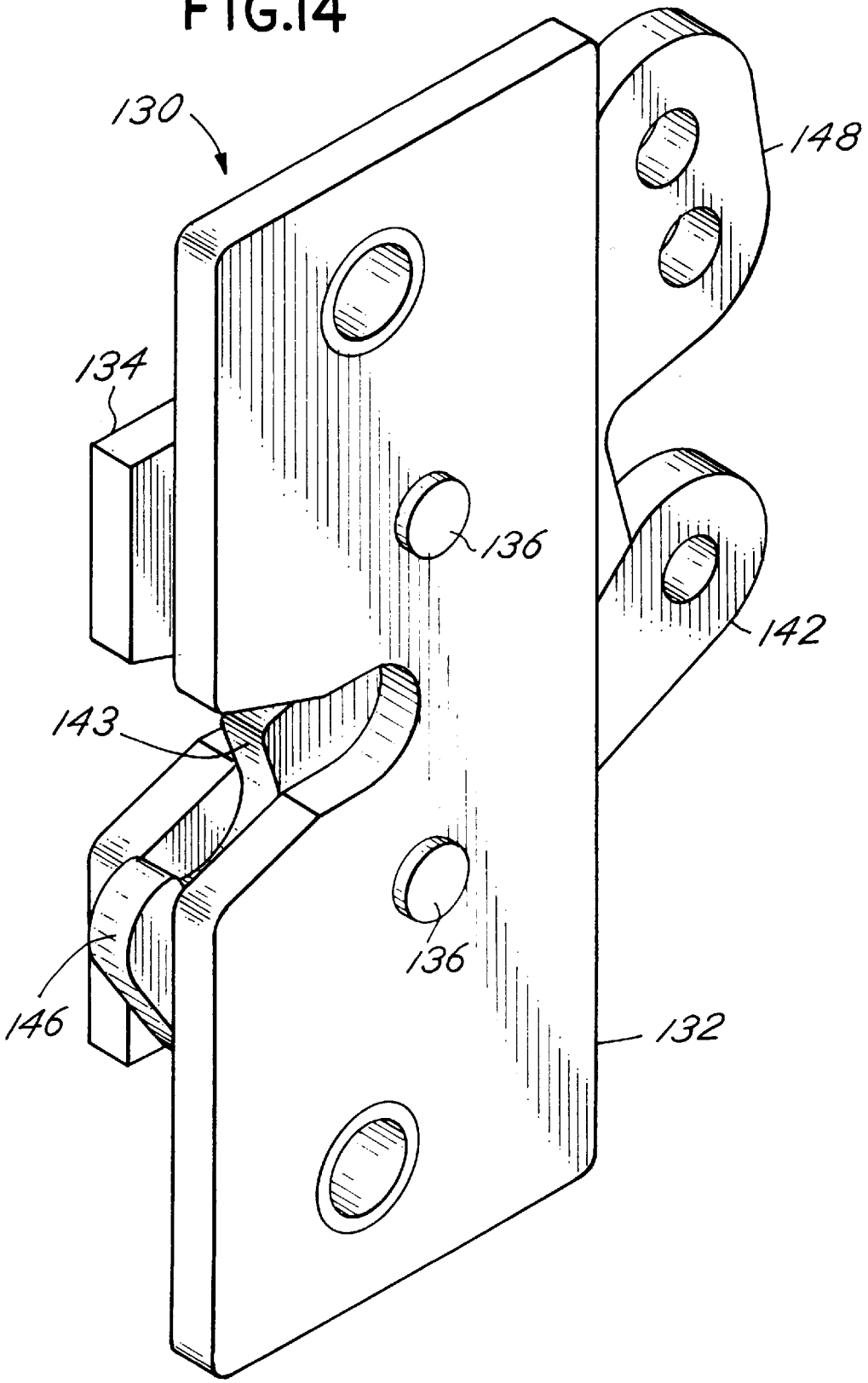
FIG. 14 is an inverted perspective view of the latching mechanism depicted in FIG. 13.

The door 62 remains in the closed position until the button or switch 182 of the remote control unit 180 is depressed or otherwise activated, as shown, for example, in FIG. 4. Upon activation, remote control signal 184 is transmitted to the electronic circuitry 160 of the lock assembly 100 which causes the electronic circuitry 160 to deliver an electronic signal to the motor of the latching mechanisms 130 instructing it to exert force 92 on the latching mechanisms 130. This electronic signal causes the locking and release levers 142 and 148 to move from the locked position toward the unlocked position which, in turn, causes the cross-members 114 of the keeper assemblies 110 to be expelled from the slots 139 of the latching mechanisms 130 as the door 62 pivots toward the open position, as shown in FIG. 5. Once the door 62 is in the open position, the vending machine 50 may be conveniently serviced. After the cross-members 114 have been expelled from the slots 139 of the latching mechanisms 130, the electronic circuitry 160 delivers a subsequent signal to the motor of the latching mechanisms 130 instructing it to transport the latching mechanisms 130 from the retracted position toward the extended position, as shown in FIG. 6, so as to properly locate the latching mechanisms 130 for the next cycle of operation.

While the present invention has been described in connection with one or more illustrated embodiments, there is no intention to limit the invention to the disclosed structural forms. On the contrary, the intention is to cover to cover all modifications, alternative constructions, and equivalents that fall within the scope and spirit of the present invention as defined by the following claims.

What is claimed is:

1. A lock assembly for vending machines comprising:

a keeper assembly for attachment to a movable door of a vending machine;

a latching mechanism mountable within an internal compartment of the vending machine and positioned to interact with the keeper assembly during locking and unlocking of the doors the latching mechanism receiving and capturing the keeper assembly when the door is moved from an open position toward an intermediate position; supporting means for mounting the latching mechanism for movement relative to the vending machine from an extended position, in which the latching mechanism extends, toward a retracted position, in which the latching mechanism is withdrawn to draw the door into a closed position; and a remote control unit for selectively disengaging the keeper assembly from the latching mechanism during unlocking of the door.

2. The invention set forth in claim 1, wherein the latching mechanism comprises a rotor latch having cooperating locking and release levers which are movable between locked and unlocked positions to selectively capture and release the keeper assembly during locking and unlocking of the door.

3. The invention set forth in claim 2, wherein the locking and release levers of the latching mechanism are pivotably sandwiched between base and cover portions.

4. The invention set forth in claim 3, wherein the base and cover portions include slots for receiving a cross-member of the keeper assembly.

5. The invention set forth in claim 2, wherein the locking lever includes a cam engagement surface which is adapted to be engaged by the keeper assembly as the door moves inwardly toward the intermediate position, a hook portion which is adapted to capture the keeper assembly when the locking and release levers are in the locked position, and upper and lower engagement surfaces which selectively engage a ratchet tooth formed on the release lever to locate the locking and release levers in the locked and unlocked positions.

6. The invention set forth in claim 5, wherein the locking and release levers are biased toward the unlocked position with a biasing element coupled therebetween.

7. The invention set forth in claim 6, wherein the locking and release levers are movable from the unlocked position toward the locked position by moving the keeper assembly into engagement with the cam engagement surface of the locking lever to counteract the biasing provided by the biasing element and to cause cooperative rotation of the locking and release levers while the ratchet tooth of the release lever moves from the upper engagement surface of the locking lever toward the lower engagement surface of the locking lever.

8. The invention set forth in claim 1, wherein the latching mechanism is slidably carried by a support structure which is adapted to be affixed to an internal side wall of the vending machine.

9. The invention set forth in claim 1, wherein the latching mechanism is moved between the extended and retracted positions with a motor.

10. The invention set forth in claim 2, further comprising:

electronic circuitry operatively connected to a motor for the latching mechanism, the electronic circuitry selectively activating the motor to move the latching mechanism inwardly and outwardly between the extended and retracted positions.

11. The invention set forth in claim 10, wherein the remote control unit transmits a signal to the electronic circuitry which instructs the motor to move the locking and release levers from the locked position toward the unlocked position to expel the keeper assembly from the latching mechanism during unlocking of the door.

12. A vending machine door locking system comprising:

a housing having a movable door;

cooperating latching and locking structures carried by respective ones of the housing and the door, the latching structure capturing the locking structure when the door is moved from an open position toward an intermediate position supporting means for mounting the latching structure for movement relative to the vending machine from an extended position, in which the latching mechanism extends at least partially beyond the side of the vending machine, toward a retracted position, in which the latching mechanism is withdrawn within the vending machine to draw the door into a closed locking position adjacent to the housing; and electronic circuitry for selectively activating movement of the latching structure between the extended and retracted positions and for selectively disengaging the locking structure from the latching structure during unlocking of the door; and a remote control unit for transmitting signals to the electronic circuitry during unlocking of the door.

13. The invention set forth in claim 12, wherein the latching structure comprises a rotor latch having cooperating levers.

14. The invention set forth in claim 13, wherein the cooperating levers of the rotor latch are movable between locked and unlocked positions to selectively capture and release the locking structure during locking and unlocking of the door.

15. The invention set forth in claim 12, wherein locking structure comprises a keeper assembly.

16. A method of locking and unlocking a movable door of a vending machine having an internal compartment and a side wall comprising the acts of:

attaching a keeper assembly to a movable door of a vending machine;

mounting a latching mechanism within an internal compartment of the vending machine in substantial alignment with the keeper assembly, said latching mechanism having an extended position and a retracted position;

moving the door inwardly from an open position, wherein the keeper assembly is spaced apart from the latching mechanism, toward an intermediate position, wherein the keeper assembly is received and captured by the latching mechanism; and locking the door of the vending machine by moving the latching mechanism to a vending machine side wall from the extended position, in which the latching mechanism extends at least partially beyond the side wall of the vending machine, toward the retracted position, in which the latching mechanism is withdrawn within the vending machine to draw the door into a closed position adjacent to a side wall of the vending machine.

17. The method set forth in claim 16, wherein the act of moving the door inwardly from an open position toward an intermediate position comprises:

moving the keeper assembly into engagement with a cooperating levers of the latching mechanism until the levers shift from an unlocked position, wherein a cam engagement surface on one of the levers is positioned for engagement by the inwardly moving keeper assembly, toward a locked position, wherein the keeper assembly is captured between the levers of the latching mechanism.

18. The method set forth in claim 16, further comprising the act of:

unlocking the door of the vending machine by moving cooperating levers of the latching mechanism from a locked position, wherein the keeper assembly is captured between the levers of the latching mechanism, toward an unlocked position, wherein the keeper assembly is expelled from the levers of the latching mechanism.

19. The method set forth in claim 18, wherein the act of unlocking the door by moving cooperating levers of the latching mechanism from a locked position toward an unlocked position comprises:

transmitting a signal from a remote control unit to electronic circuitry for the lock assembly in order to instruct a motor for the latching mechanism to move the levers from the locked position toward the unlocked position so as to expel the keeper assembly from the latching mechanism.

* * * * *